United States Patent [19]

Inoue et al.

[11] Patent Number: 5,000,074

[45] Date of Patent: Mar. 19, 1991

[54] EFFECT IMPARTING DEVICE FOR AN ELECTRONIC MUSICAL INSTRUMENT OR THE LIKE APPARATUS

[75] Inventors: Toshihiro Inoue; Akira Iizuka; Chifumi Takeuchi, all of Hamamatsu, Japan

[73] Assignee: Yamaha Corporation, Hamamatsu, Japan

[21] Appl. No.: 370,621

[22] Filed: Jun. 23, 1989

[30] Foreign Application Priority Data

| | | | |
|---|---|---|---|
| Jun. 23, 1988 | [JP] | Japan | 63-155152 |
| Jun. 23, 1988 | [JP] | Japan | 63-155153 |
| Oct. 25, 1988 | [JP] | Japan | 63-267188 |

[51] Int. Cl.[5] ..... G10H 1/057; G10H 7/00

[52] U.S. Cl. ..... 84/621; 84/627; 84/630; 381/61; 381/63; 381/118

[58] Field of Search ..... 84/621, 626, 627, 629, 84/630, 662, 663, 683, 691, 701, 702, 705, 706, 707, 737, 738, 739, 740, DIG. 26; 381/61, 62, 63, 118

[56] References Cited

U.S. PATENT DOCUMENTS

| | | | |
|---|---|---|---|
| 4,472,993 | 9/1984 | Futamase et al. | 84/1.24 |
| 4,569,268 | 2/1986 | Futamase et al. | 84/1.24 |
| 4,909,120 | 3/1990 | Horiki et al. | 84/627 |
| 4,909,121 | 3/1990 | Usa et al. | 84/627 |

FOREIGN PATENT DOCUMENTS

| | | |
|---|---|---|
| 58-14191 | 1/1983 | Japan . |
| 58-14898 | 1/1983 | Japan . |
| 62-91998 | 4/1987 | Japan . |

*Primary Examiner*—W. B. Perkey

*Attorney, Agent, or Firm*—Spensley Horn Jubas & Lubitz

[57] ABSTRACT

A variable delay circuit for delaying an input signal and being capable of changing length of this delay is provided and various modulation effects are imparted by this delay. When change in the delay length has been designated, a decay envelope is imparted to a delay output tone signal corresponding to the delay length before the change and then a rise envelope is imparted to a delay output signal corresponding to the delay length after the change. Generation of a click noise during the change in the delay length thereby is prevented. Alternatively, when the delay length is to be changed, a decay envelope is imparted to a delay output signal corresponding to the delay length before the change and, simultaneously, a rise envelope is imparted to a delay output tone signal corresponding to the delay length after the delay and the two signals are combined. Alternatively further, when the delay length is to be changed, the delay length is sequentially changed in plural steps from the delay length before the change to the delay length after the change.

11 Claims, 5 Drawing Sheets

EFFECT IMPARTING DEVICE FOR AN ELECTRONIC MUSICAL INSTRUMENT OR THE LIKE APPARATUS

BACKGROUND OF THE INVENTION

The invention relates to an effect imparting device used in an electronic musical instrumental or the like apparatus and, more particularly, to an effect imparting device of a type imparting a desired effect by delaying a tone signal capable of eliminating or preventing a click noise produced in changing length of delay.

In effect imparting devices used in electronic musical instruments or the like apparatus, there are devices imparting modulation effects such as "delay", "reverberation", "phase shifting", "vibrato" and "termolo" by employing a digital delay device (e.g., Japanese Preliminary Patent Publication Nos. 58-14191 corresponding to U.S. Ser. No. 07/161,344 and 58-14898 corresponding to U.S. Ser. No. 07/022,582, U.S. Pat. No. 4,472,993 and U.S. Pat. No. 4,569,268).

Delay length in a digital delay device sometimes is automatically changed during processing of a tone signal by operation by a player or in accordance with a processing program. In that case, there arises the inconvenience that the phase of a delay output signal after the change becomes discontinuous to that before the change resulting in generation of a click noise in a signal portion at the change. Particularly, in an effect, e.g., an reverberation effect, in which a delay output signal is fed back to the input side of the delay device, the click noise thus generated also is fed back, and this poses a serious problem.

SUMMARY OF THE INVENTION

It is an object of the invention to provide an effect imparting device capable of eliminating or preventing such click noise.

The effect imparting device according to the invention is characterized in that it comprises variable delay means for delaying an input tone signal to impart the tone signal with an effect provided by this delay and being capable of changing length of this delay, and envelope imparting means for imparting, when the delay length of the variable delay means is to be changed, a decay envelope to an output signal of the variable delay means corresponding to a delay length before the change and thereafter imparting a rise envelope to an output of the variable delay means corresponding to a delay length after the change thereby to eliminate a click noise generated when the delay length is changed.

According to the invention, a decay envelope is imparted to the output signal of the variable delay means corresponding to the delay length before the change and thereafter a rise envelope is imparted to the output signal of the variable delay means corresponding to the delay length after the change. Therefore, the output signal of the variable delay means corresponding to the delay length before the change decays gradually and then the output signal of the variable delay means is changed to that corresponding to the delay length after the change and this signal rises gradually. By this arrangement, even if the output signal of the variable delay means corresponding to the delay length before the change is not in phase with the output signal of the variable delay means corresponding to the delay length after the change, the signal level of a signal portion at the change is restrained by the decay characteristic and the subsequent rise characteristic and a click noise thereby is eliminated.

In another aspect of the invention, the effect imparting device according to the invention is characterized in that it comprises combining means for producing, when the delay length of the variable delay means is to be changed, at least a first delay output signal corresponding to a delay length before the change and a second delay output signal corresponding to a delay length after the change respectively from the variable delay means, imparting a decay envelope to the first delay output signal to gradually decrease the level of the first delay output signal, imparting, in parallel thereto, a rise envelope to the second delay output signal to gradually increase the level of the second delay output signal, and combining the two signals thus imparted with the envelopes together to provide the composite signal as a delayed output tone signal.

When the delay length is to be changed, the first delay output signal corresponding to delay length before the change and the delay output signal corresponding to delay length after the change are produced simultaneously from the variable delay means. A decay envelope is imparted to the first delay output signal and the level of the first delay output signal thereby decays gradually. Simultaneously, a rise envelope is imparted to the second delay output and the level of the second delay output signal thereby rises gradually. The two signals which have thus been imparted with the envelopes of opposite characteristics are combined together and this comprise signal becomes a delayed output tone signal.

In still another aspect of the invention, the effect imparting device according to the invention is characterized in that it comprises delay length changing means for changing, when the delay length of the variable delay means is to be changed, the delay length gradually at a relatively small unit from a delay length before the change to a delay length after the change thereby to prevent a click noise generated when the delay length is changed.

When delay length of the variable delay means is to be changed, the delay length is changed gradually from the delay length before the change to the delay length after the change by a relatively small unit. Accordingly, the delay length in the variable delay means gradually slides by a relatively small unit without an abrupt change from the delay length before the change to the delay length after the change. By this arrangement, even if there is discontinuity between the phase of the output signal of the variable delay means corresponding to the delay length before the change and the phase of the output signal corresponding to the delay length after the change, the phase of the output signal of the variable delay means is continuously changed in a relatively smooth manner owing to the gradual change in the delay length so that a click noise can be prevented.

BRIEF DESCRIPTION OF THE DRAWINGS

In the accompanying drawings.

DESCRIPTION OF PREFERRED EMBODIMENTS

Preferred embodiments of the invention will now be described with reference to the accompanying drawings.

Figure 1:
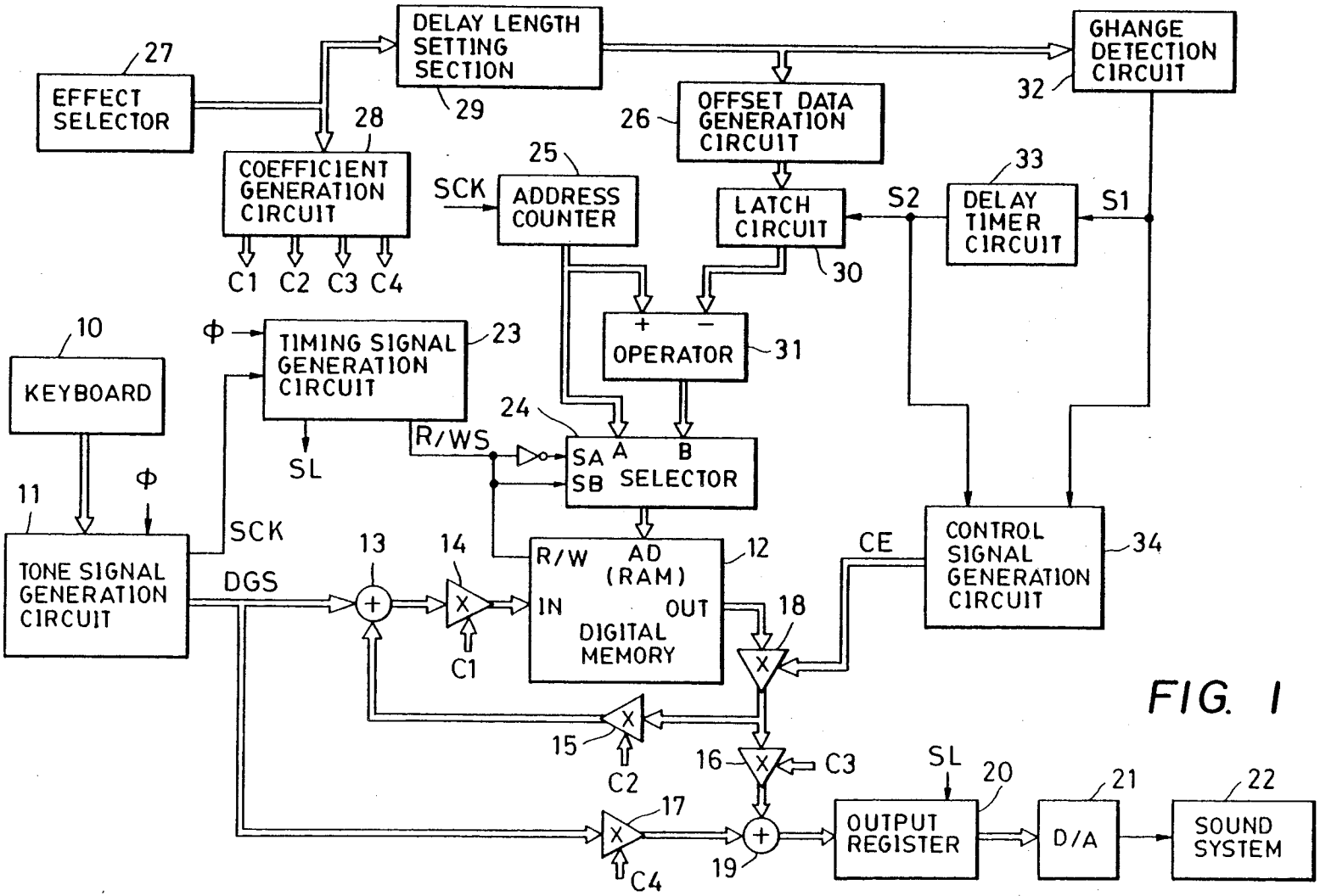
FIG. 1 is a block diagram showing an embodiment of an electronic musical instrument incorporating the effect imparting device according to the invention.

FIG. 1 shows an embodiment of the invention applied to a reverberation effect device in an electronic musical instrument. A tone signal corresponding to a key depressed in a keyboard 10 is generated in digital by a tone signal generation circuit 11.

A digital memory 12 consisting of a RAM constitutes a variable delay device. A digital tone signal DGS generated by the tone signal generation circuit 11 is applied to data input IN of the digital memory 12 through an adder 13 and a multiplier 14. An output OUT of the digital memory 12 corresponds to a delay output of the variable delay device. This delay output is applied to the adder 13 through multipliers 18 and 15 and fed back to the input side of the variable delay device. The delay output is applied to an adder 19 through the multipliers 18 and 16 and added to an input tone signal applied to the adder 19 through a multiplier 17. The output of this adder 19 is latched by an output register 20 and thereafter is supplied to a digital-to-analog converter 21 as a digital tone signal imparted with the reverberation effect. The output analog signal of the digital-to-analog converter 21 is supplied to a sound system 22. Parameters C1–C4 for setting the reverberation effect are supplied to coefficient inputs of the multipliers 14–17. To a coefficient input of the multiplier 18 is supplied an envelope signal CE for imparting signal CE normally is a constant value corresponding to coefficient 1 and an output signal read from the digital memory 12 passes through the multiplier 18.

Figure 2:
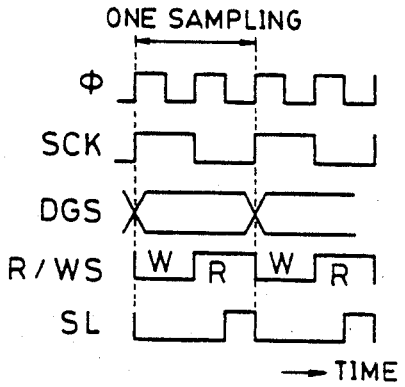
FIG. 2 is a time chart showing an example of read and write control image timings in the digital memory of FIG. 1.

A timing signal generation circuit 23 generates a read and write control signal R/WS for controlling reading and writing of the digital memory 12. A sampling clock pulse SCK is generated by the tone signal generation circuit 11 in synchronism with the sampling period of the digital tone is signal DGS and supplied to the timing signal generation circuit 23. The timing signal generation circuit 23 generates, in response to this sampling clock pulse SCK and the system clock pulse $\phi$ the read and write control signal R/WS which designates writing during the former half period of the sampling period and designates reading during the latter half period of the sampling period. The timing signal generation circuit 23 generates also a load signal SL during the last quarter period of the sampling period. An example of a time chart of these pulses is shown in FIG. 2.

The read and write control signal R/WS is supplied to a read and write control input R/W of the digital memory 12 whereby, as described above, the digital tone signal sampled value data supplied to the data input IN during the former half period of one sampling period of the digital tone signal DGS is written and the digital signal sampled value data is read out during the latter half period. A write address and a read address are designated by data supplied to the address input AD from a selector 24. The load signal SL is supplied to a load control input of the output register 20 to load in the output register 20 digital tone signal data for one sample point which has been supplied from the adder 19 and has been subjected to the effect operation.

An address counter 25 prepares write address data by sequentially counting the sampling clock pulse SCK. The count output of this address counter 25 is applied to an A input of the output selector 24 and, when the read and write control signal R/WS is "0", i.e., during the write mode which is the former half period of the sampling period, the count output is supplied as write address designation data to the address input AD of the digital memory 12. The sampled value data of the input digital tone signal is sequentially written in the sequential addresses of the digital memory 12 in accordance with its time sequence.

In the digital memory 12, by shifting (i.e., offsetting) the read address of the digital tone signal thus written sequentially in the sequential a addresses from the write address, delay is performed in accordance with the offset address amount. Offset data for this purpose is generated by an offset data generation circuit 26.

An effect selector 27 selects the reverberation effect. A coefficient generation circuit 28 generates coefficients C1–C4 in response to the reverberation effect selected and supplies these coefficients to the multipliers 14–17. A delay length setting section 29 generates data designates a delay length in response to the selected reverberation effect. The offset data generation circuit 26 generates offset data corresponding to the delay length designated by this delay length setting section 29. The delay length setting section 29 may also be a manually operated delay length setting device which is not interlocked with the effect selector 27.

This offset data is latched by a latch circuit 30 and supplied to an operator 31. The operator 31 receives at another input thereof count data of the address counter 25. By, for example, subtracting the offset data from this count data, the read address data is prepared as a result of the operation. The read address data produced by the operator 31 is supplied to a B output of the selector 24 and, when the read and write control signal R/WS is "1", i.e., during the read mode which is the latter half period of the sampling period, it is selected and supplied as read address designation data to the address input AD of the digital memory 12.

A change detection circuit 32 detects the designation that the delay length in the digital memory 12 should be changed. More specifically, the change detection circuit 32 detects that the delay length should be changed by detecting that the output data of the delay length setting section 29 has changed. Upon detection of the change by the change detection circuit 32, a pulse S1 is produced and this pulse S1 is applied to a delay timer circuit 33 and a control signal generation circuit 34.

Figure 3:
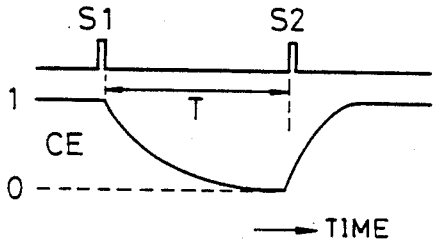
FIG. 3 is a diagram showing an example of an envelope imparted to a delay output signal before and after change in delay length in the digital memory of FIG. 1.

The control signal generation circuit 24 generates, as shown in FIG. 3, a decay envelope waveform in response to application of the pulse S1 and provides this waveform as the envelope signal CE. In the multiplier 18, the delay output signal produced by the digital memory 12 is imparted with a decay envelope by this envelope signal CE of a decay envelope characteristic so that the tone volume of the delay output signal is attenuated.

The delay timer circuit 33 delays the input pulse S1 by a predetermined period of time T and provides the delayed pulse as a pulse S2. This pulse S2 is applied to a load control input of the latch circuit 30 and the control signal generation circuit 34.

The latch circuit 30 latches the offset data from the offset data generation circuit 26, i.e., offset data setting the delay length after the change, in response to the pulse S2.

The control signal generation circuit 34 generates, as shown in FIG. 3, a rise envelope waveform in response to application of the pulse S2 and provides this waveform as an envelope signal CE. In the multiplier 18, the delay output signal from the digital memory 12 is imparted with a rise envelope by this envelope signal CE of a rise envelope characteristic so that the tone volume of the delay output signal increases gradually.

In the foregoing manner, notwithstanding that change in the delay length in the digital memory 12 is designated, new offset data setting the delay length after the change is not immediately latched by the latch circuit 30 but is delayed by the delay time T of the delay timer circuit 33. During the delay, the decay envelope is imparted to the delay output signal corresponding to the delay length before the change so that the delay output signal is gradually attenuated. Then, new offset data is latched by the latch circuit 30 and the delay output signal corresponding to the delay length after the change is provided from the digital memory 12. The rise envelope is imparted to the delay output signal corresponding to the delay length after the change so that the tone volume of the delay output signal rises gradually. By this arrangement, even if the delay output signal corresponding to the delay length before the change is not in phase with the delay output signal corresponding to the delay length after the change, the signal level of the transient portion is smoothly restrained by the decay characteristic and the succeeding rise characteristic whereby click noise can be eliminated.

Time difference between the pulse S1 and the pulse S2, i.e., the delay time T of the delay timer circuit 33 is set to time length which is sufficient for attenuating the tone volume of the delay output signal corresponding to the delay length before the change. This time length is, for example, 30–50 ms.

In the above described embodiment, the decay envelope is imparted to the delay output signal corresponding to the delay time before the change during the predetermined time T. The time during which the decay envelope is imparted, however, is not limited to the predetermined time T but the decay envelope may be imparted until the tone volume is attenuated below a certain level.

Figure 4:
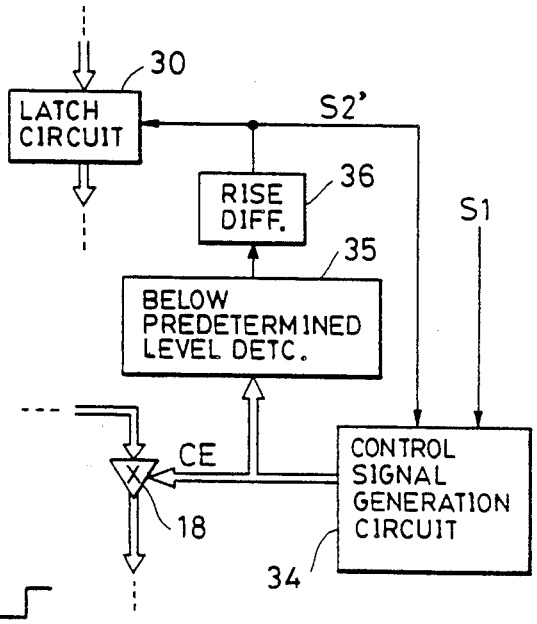
FIG. 4 is a block diagram showing a modified example of the embodiment of FIG. 1.

For this purpose, the related portion in the delay timer circuit 33 and the control signal generation circuit 34 in FIG. 1 may be modified as shown in FIG. 4. In the example of FIG. 4, the delay timer circuit 33 of FIG. 1 is omitted and a below-predetermined-level detection circuit 35 and a rise differentiation circuit 36 are provided. The envelope signal CE provided by the control signal generation circuit 34 is applied to the below-predetermined level detection circuit 35 and, when the level of the envelope signal CE has fallen below a predetermined level representing a sufficient decay, this state is detected. Responsive to the detection output of the below-predetermined-level detection circuit 35, the rise differentiation circuit 36 produces a pulse S2' which is applied, instead of the pulse S2, to the load control input of the latch circuit 30 and the control signal generation circuit 34.

The change detection circuit 32 may be so constructed that it detects not only change in the delay length but also the magnitude of the change so that the control according to this invention will be not made when the amount of change in the delay length is not so large.

Figure 5:
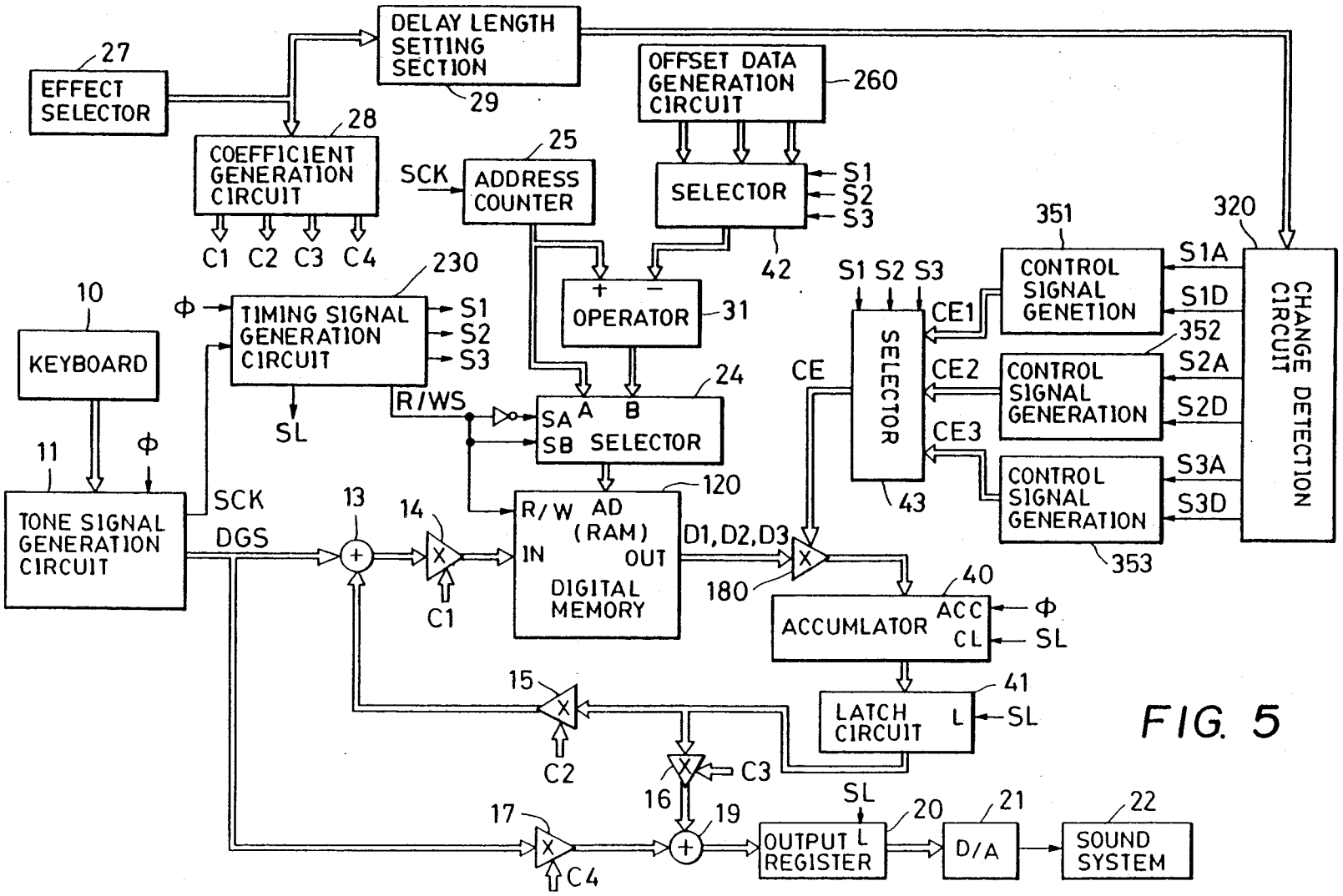
FIG. 5 is a block diagram showing another embodiment of an electronic musical instrument incorporating the effect imparting device according to the invention.

Referring now to FIG. 5, another embodiment of the invention will be described. In FIG. 5, the elements of the same reference characters as those of FIG. 1 perform the same function as those of FIG. 1.

In FIG. 5, the structures of a timing signal generation circuit 230 and an offset data generation circuit 260 as somewhat different from the corresponding circuits in FIG. 1 and, besides, the structure of a change detection circuit 320 is different from the change detection circuit 32 of FIG. 1.

A delay output OUT of a digital memory 120 is applied to an adder 13 through a multiplier 180, an accumulator 40, a latch circuit 41 and a multiplier 15 and fed back to the input side of the variable delay device. The delay output provided through the multiplier 180, accumulator 40 and latch circuit 41 is applied also to an adder 19 through a multiplier 16 and added to an input tone signal supplied to the adder 19 through a multiplier 17.

The digital memory 120 shifts (offsets) read addresses of a digital tone signal sequentially written in respective addresses from write addresses and thereby performs delay corresponding to the offset address amount.

In this embodiment, the variable delay length in the digital memory 120 is limited to only three stages and delay output signals D1, D2 and D3 of the three stages are constantly provided by the digital memory 120 on a time shared basis.

Figure 6:
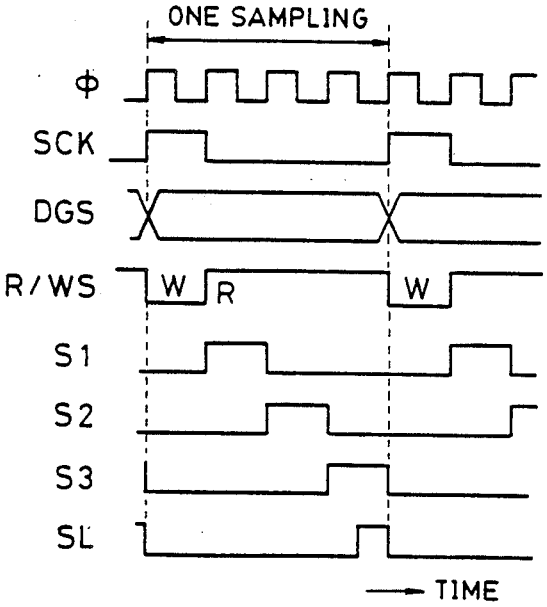
FIG. 6 is a time chart showing an example of read and write control timings of the digital memory FIG. 5.

A timing signal generation circuit 230 generates, in the same manner as was previously described, a signal R/WS for controlling reading and writing in the digital memory 120 and also various control signals SL, S1, S2 and S3. More specifically, the timing signal generation circuit 230 generates a read and write control signal R/WS designating writing during the first quarter period of the sampling period and designating reading during the remaining three quarter periods of the sampling period in response to a sampling clock pulse SCK and a system clock pulse $\phi$. The timing signal generation circuit 230 generates also time division selection signals S1, S2 and S3 corresponding to periods provided by dividing the remaining three quarter periods of the sampling period by three and further generates a load signal SL corresponding to the latter half of the period during which the last time division selection signal S3 is produced. The time division selection signals S1, S2 and S3 are control signals for outputting the three stage delay output signals D1, D2 and D3 from the digital memory 120 on a time shared basis. The load signal SL is applied, in the same manner as was previously described, to a load control input of an output register 20. An example of a time chart of these pulses and signals is shown in FIG. 6.

The read and write control signal R/WS is supplied to a read and write control input R/W of the digital memory 120. As described, the digital tone signal sampled value data applied to a data input IN is written during the first quarter period of one sampling period of a digital tone signal DGS and the three stage delay output signals D1, D2 and D3 are read out on a time shared basis during the remaining three quarter period. The write addresses and read addresses are designated by data supplied from a selector 24 to the address input AD of the digital memory 120.

When the output of an address counter 25 is applied to an A input of the selector 24 and the read and write control signal R/WS is "0", i.e., during the write mode of the first quarter period of the sampling period, the count output of the address counter 25 is selected by the selector 24 and supplied as write address designation data to the address input AD of the digital memory 120. Accordingly, the sampled value data of the input digital tone signal is sequentially written in the sequential addresses of the digital memory 120 in accordance with its time sequence.

By shifting (offsetting) the read addresses of the digital tone signal sequentially written in the sequential addresses from the write addresses in the same manner as was previously described, delay is performed in the digital memory 120 in accordance with the offset address amount. Offset data for this purpose is generated by an offset data generation circuit 260.

On the other hand, the envelope signals CE for imparting envelope to the delay output signals D1, D2 and D3 of the respective stages are supplied on a time shared basis to the coefficient input of the multiplier 180. Among the envelope signals CE, one corresponding to a delay output signal to be selected (one of D1, D2 and D3) is of a constant value corresponding to coefficient 1 and others corresponding to the other delay output signals are of a value corresponding to coefficient 0. When the delay length is to be changed, the envelope signal CE corresponding to the delay length before the change (one of D1, D2 and D3) decays gradually from the constant value corresponding to the coefficient 1 whereas the envelope signal CE corresponding to the delay length after the change (one of D1, D2 and D3) rises gradually from the value corresponding to the coefficient 0 to the constant value corresponding to the coefficient 1. The delay output signals D1, D2 and D3 of the respective stages which have been controlled in envelope by the multiplier 180 are supplied to an accumulator 40 and accumulated therein. A composite signal of the three envelope-controlled delay output signals D1, D2 and D3 summed by the accumulator 40 is latched by a latch circuit 41 at the end of the sampling period in response to the load signal SL. Simultaneously, the contents of the accumulator 40 are cleared in response to this load signal SL. The output of the latch circuit 41 is supplied as a final delay output signal to the multipliers 15 and 16.

The offset data generation circuit 260 generates offset data 01, 02 and 03 corresponding to the variably settable three stage delay lengths. These offset data 01, 02 and 03 are selected on a time shared basis by a selector 42 in response to the time division selection signals, S1, S2 and S3 and supplied to an operator 31. To the other input of the operator 31 is applied count data of an address counter in the same manner as was previously described. By, for example, subtracting the offset data 01, 02 and 03 respectively from this count data, three road address data corresponding to the respective delay lengths are prepared in time division. The three read address data provided on a time shared basis from the operator 31 are supplied to a B input of a selector 24. When the read and write control signal R/WS is "1", i.e., during the read mode in the remaining three quarter periods of the sampling period, the three read address data are respectively selected by the selector 24 and supplied to the address input AD of the digital memory 120 as read address designates data.

The change detection circuit 320 detects that the delay length in the digital memory 120 should be changed. More specifically, by detecting change in the output data of the delay length setting section 29, it is detected that the delay length should be changed and is also detected from which stage to which stage the delay length has been changed. Responsive to the detection, the change detection circuit 320 produces envelope designation signals S1A, S1D, S2A, S2D, S3A, S3D. The manner of generation of these envelope designation signals is as follows:

When it has been detected that the delay length should be changed from one corresponding to the delay output signal D1 to one corresponding to the delay output signal D2, the decay envelope designation signal S1D for D1 and the rise envelope designation signal S2A for D2 are generated.

When is has been detected that the delay length should be changed from one corresponding to the delay output signal D1 to one corresponding to the delay output signal D3, the decay envelope designation signal S1D for D1 and the rise envelope designation signal S3A for D3 are generated.

When it has been detected that the delay length should be changed from one corresponding to the delay output signal D2 to one corresponding to the delay output signal D1, the decay envelope designation signal S2D for D2 and the rise envelope designation signal S1A for D1 are generated.

When it has been detected that the delay length should be changed from one corresponding to the delay output signal D2 to one corresponding to the delay output D3, the decay envelope designation signal S2D for D2 anD the rise envelope designation signal S3A for D3 are generated.

When it has been detected that the delay length should be changed from one corresponding to the delay output signal D3 to one corresponding to the delay output signal D1, the decay envelope designation signal S3D for D3 and the rise envelope designation signal S1A for D1 are generated.

When it has been detected that the delay length should be changed from one corresponding to the delay output signal D3 to one corresponding to the delay output signal D2, the decay envelope designation signal S3D for D3 and the rise envelope designation signal S2A for D2 are generated.

The decay envelope designation signal S1D and the rise envelope designation signal S1A for D1 are applied to a control signal generation circuit 351 for D1. This control signal generation circuit 351 generates the envelope signal CE for D1. More specifically, the circuit 351 generates the envelope signal CE1 in such a manner that, upon receipt of the rise envelope designation signal S1A, the envelope signal CE1 rise gradually with a predetermined rise characteristic from the value corresponding to the coefficient 0 to the constant value corresponding to the coefficient 1, thereafter value corresponding to the coefficient 1, thereafter maintains the constant value corresponding to the coefficient 1 and, upon receipt of the decay envelope designation signal S1D thereafter, decays gradually with a predetermined decay characteristic from the constant value corresponding to the coefficient 1 to the value corresponding to the coefficient 0 and thereafter maintains the value corresponding to the coefficient 0.

The decay envelope designation signal S2D and the rise envelope designation signal S2A for D2 are applied to a control signal generation circuit 352 for D2. This control signal generation circuit 352 generates the envelope signal CE2 for D2 with the same characteristic.

The decay envelope designation signal S3D and the rise envelope designation signal S3A for D3 are applied to a control signal generation circuit 353 for D3. This control signal generation circuit 353 generates the envelope signal CE3 for D3.

These envelope signals CE1–CE3 are selected on a time shared basis by a selector 43 in response to time division selection signals S1, S2 and S3 and supplied to the multiplier 180 as the time division envelope signals CE.

Figure 7:
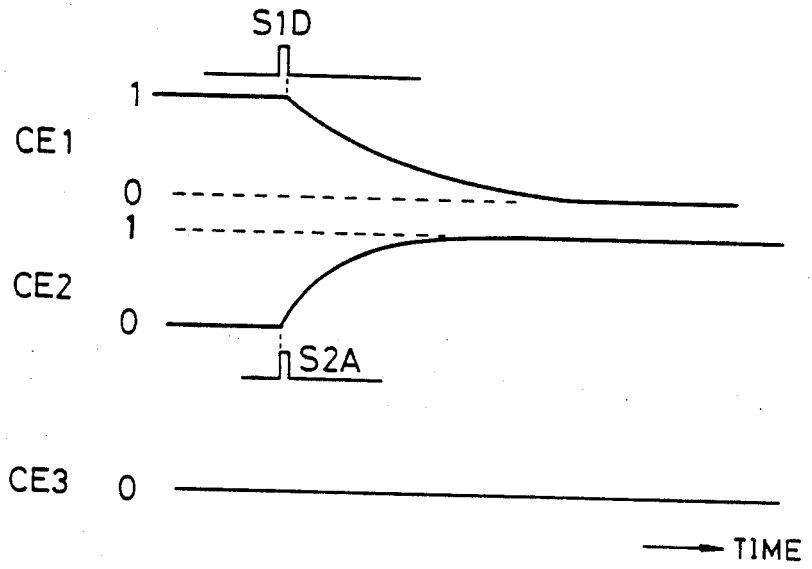
FIG. 7 is a diagram showing an example of an envelope imparted to a delay output signal before and after change of delay length of the digital memory of FIG. 5.

Accordingly, if, for example, it has been detected that the delay length should be changed from one corresponding to the delay output signal D1 to one corresponding to the delay output signal D2, the decay envelope designation signal S1D for D1 and the rise envelope designation signal S2A for D2 are generated and, in response to these signals, the envelope signal CE1 for D1 decays from the constant value corresponding to the coefficient 1 to the value corresponding to the coefficient 0 and, simultaneously, the envelope signal CE2 for D2 rises from the value corresponding to the coefficient 0 to the constant value corresponding to the coefficient 1 (see FIG. 7). In this case, the envelope signal CE for D3 does not change, maintaining the value corresponding to the coefficient 0.

In response to this envelope signal CE1 of the decay characteristic, a decay envelope is imparted by the multiplier 180 to the delay output signal D1 provided by the digital memory 120 to attenuate the tone volume of the delay output signal D1. In response to the envelope signal CE2 of the rise characteristic, a rise envelope is imparted by the multiplier 180 to the delay output signal D2 provided by the digital memory 120 to increase the tone volume of the delay output signal D2 gradually. In this manner, the signals D1 and D2 which have been imparted with opposite characteristics are combined together and this composite signal constitutes the output signal of the variable delay device. By this arrangement, if the delay output signal D1 corresponding to the delay length before the change is not in phase with the delay output signal D2 corresponding to the delay length after the change, the switching between the two signals D1 and D2 is made smoothly by interpolation of the two signals imparted with the opposite characteristics whereby a delay output signal capable of preventing generation of a click noise in the switching portion between the two signals can be obtained.

The decay time for the decay envelope portion is set to time length which is sufficient for smooth attenuation of the tone volume of the delay output signal for prevention of the click noise, e.g., 30–50ms.

In the above described embodiment, description has been made about a case where the variable delay stages are three stages. The invention is not limited to this but it may be applied to any desired number of variable delay stages.

Figure 8:
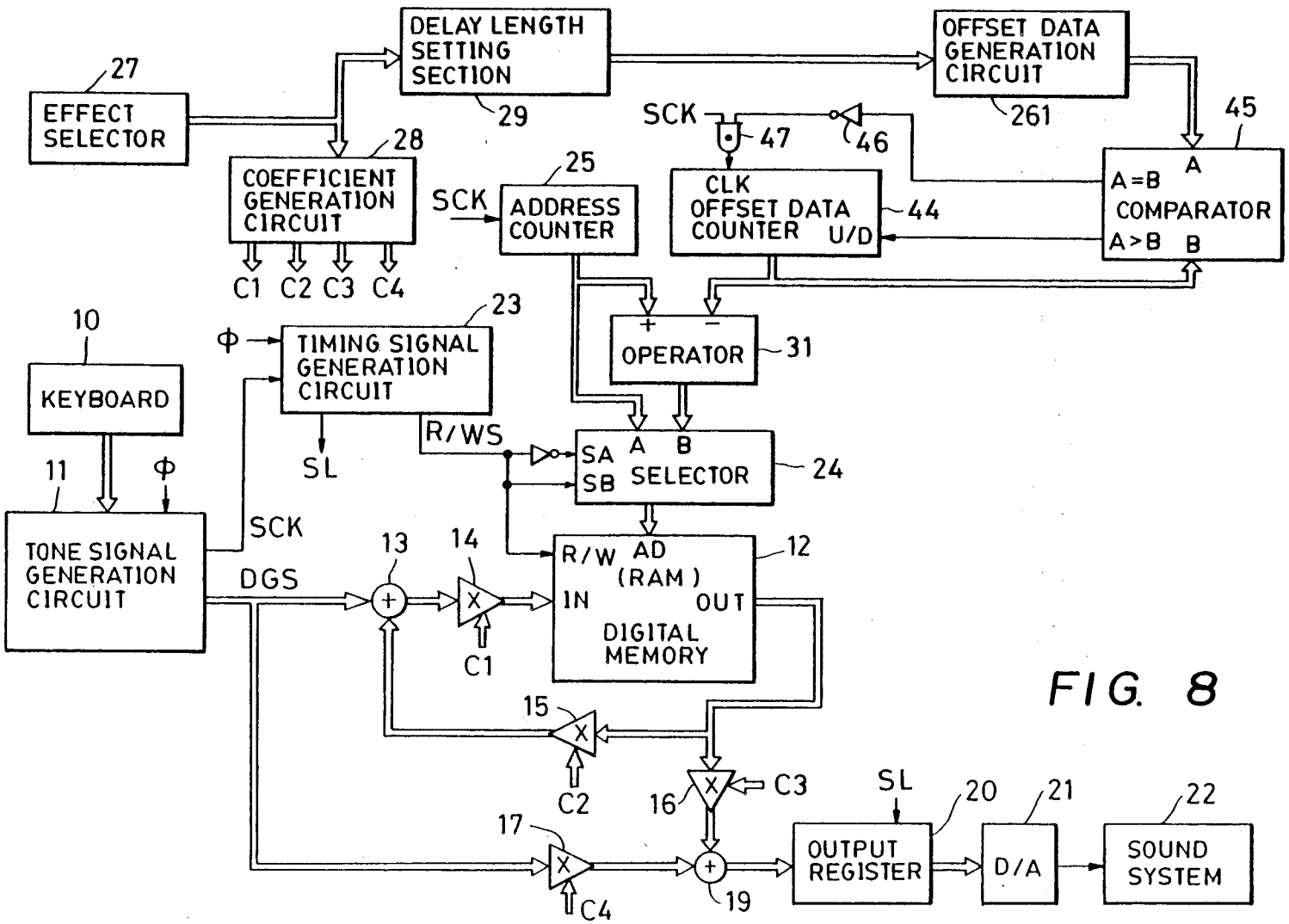
FIG. 8 is a block diagram showing still another embodiment of the invention.

Referring next to FIG. 8, another embodiment of the invention will be described. In FIG. 8, the same elements designated by the same reference characters perform the same function as those of FIG. 1.

In FIG. 8, the structure of an offset data generation circuit 261 is somewhat different from the one shown in FIG. 1. Besides, the multiplier 18 on the output side of the memory 12 in FIG. 1 is omitted and the output of the digital memory 12 is applied directly to multipliers 15 and 16. The read/write operation timing is the digital memory 12 is the same as that of FIG. 2. The offset data is supplied from an offset data counter 44.

Offset data generated by the offset data generation circuit 261 is applied to an A input of a comparator 45. To a B input of the comparator 45 is applied the output of the offset data counter 44. The comparator 45 compares the A input with the B input and, if A is equal to B, produces a signal "1" at its "A=B" output and otherwise produces a signal "0". If the A input is larger than the B input, the comparator 45 produces a signal "1" at its "A>B" output and otherwise produces a signal "0". The "A>B" output signal is inverted by an inverter 46 and supplied to a count clock input CLK of the offset data counter 44 through and AND gate 47. To the other input of the AND gate 47 is supplied the sampling clock pulse SCK. The "A>B" output signal of the comparator 45 is supplied to an up/down count control input U/D of the offset data counter 44.

The output of the offset data counter 44 is applied to the comparator 45 as described and also to the operator 31. The result of operation in the operator 31 is supplied to the address input AD of the digital memory 12 through the B input of the selector 24 as the read address designation data in the above described manner.

When the delay length designated by the delay length setting section 29 has been changed, the offset data generated by the offset data generation circuit 261 is changed. The offset data generated, however, is not supplied to the memory 12 directly through the operator 31 and the selector 24 but it is supplied to the memory 12 through the offset data counter 44.

Figure 9:
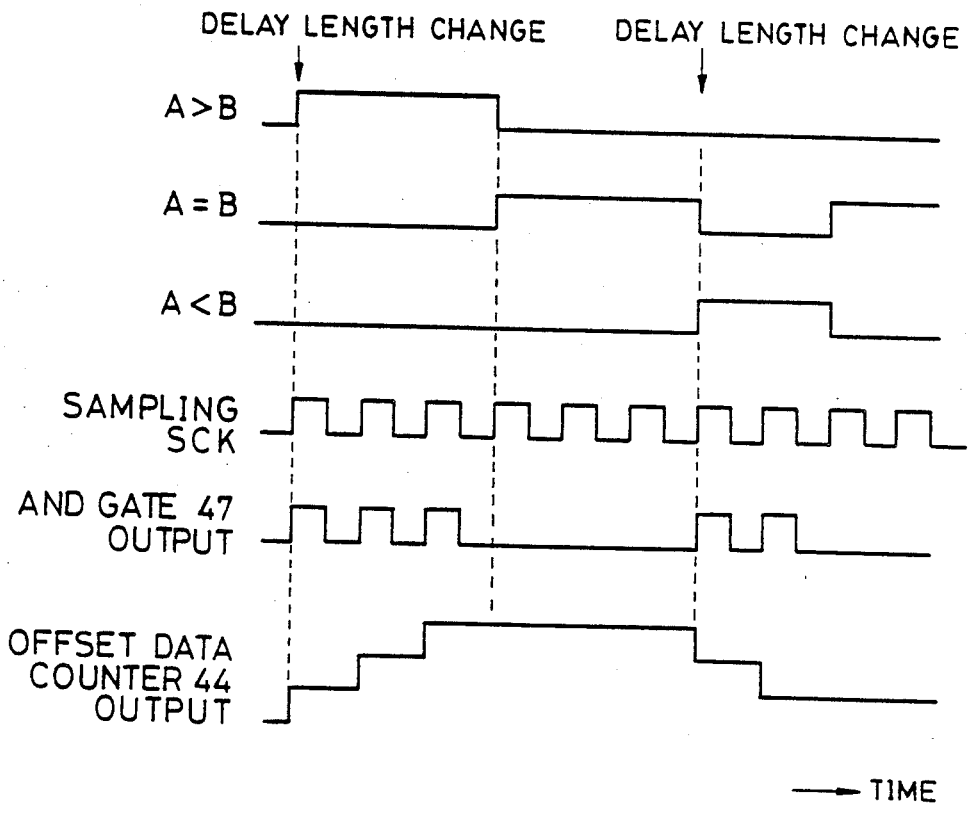
FIG. 9 is a time chart showing an example of counting operation of the offset data counter of FIG. 8.

Referring to FIG. 9, this circuit portion will be described further. When the delay length designated by the delay length setting section 29 has been changed, the offset data generated by the offset data generation circuit 261 corresponds to the delay length after the change whereas the count data provided by the offset data counter 44, i.e., offset data setting the actual delay length, corresponds to the delay length before the change. If the delay length after the change is larger than the delay length before the change, the condition A >B is satisfied in the comparator 45 and the output "A >B" is "1" so that the counting mode of the offset data counter 44 is an upcount mode. Since the AND gate 47 is enabled, the offset data counter 44 upcounts the sampling clock pulse SCK. The count data produced by the offset data counter 44, i.e., the offset data setting the actual delay length, thereby increases gradually from a value corresponding to the delay length before the change to a value corresponding to the delay length after the change. Upon coincidence of the output of the offset data center 44 with the value corresponding to the delay length after the change, the condition A=B is satisfied in the comparator 45. The output "A=B" therefore becomes "1" and the AND gate 47 is disabled to stop counting in the offset data counter 44.

The output of the offset data counter 44, i.e., the offset data setting the actual delay length, maintains the value corresponding to the delay length after the change. If the delay length after the change is smaller than the delay length before the change, the condition A > B is not satisfied in the comparator 45 so that the "A > B" output is "0" and the counting mode of the offset data counter 44 is a down count mode. Since the "A = B" output is "0" and the AND gate 47 is enabled, the offset data counter 44 downcunts the sampling clock pulse SCK. The count data produced by the offset data counter 44, i.e., the offset data setting the actual delay length, thereby decreases gradually from the value corresponding to the delay length before the change to the value corresponding to the delay length after the change.

In the foregoing manner, even if change in the delay length in the digital memory 12 which is the variable delay device has been designated, the offset data setting the delay length after the change is not applied directly to the operator 31 but applied after being processed in a manner to gradually change from the offset data setting the delay length before the change through the comparator 45 and the offset data counter 44. By this arrangement, in a case where the delay output signal corresponding to the delay length before the change is not in phase with the delay output signal after the change, the read address of the digital memory 12 changes gradually from the address corresponding to the delay length before the change to the address corresponding to the delay length after the change, resulting in smooth change in the phase and prevention of the click noise.

The pulse applied to the offset data counter 44 as the count clock pulse CLK is not limited to the sampling clock pulse SCK but may be a signal obtained by suitably frequency-dividing the sampling clock pulse SCK or a signal generated by an independent clock pulse generation circuit. A signal which is of a slower rate than the sampling clock pulse SCK is preferable because it results in generation of less click.

In the above described embodiment, unit delay length in the gradual change from the value corresponding to the delay length before the change to the value corresponding to the delay length after the change is the minimum unit, i.e., 1 address unit. The invention is not limited to this but the gradual change may be achieved by using a delay length corresponding to 2 or more addresses as one unit (though it should be a sufficiently small unit for preventing generation of click).

In the above described embodiments, a RAM (random-access memory) is used as the variable delay device. Alternatively, other digital delay circuits such as a shift register may be utilized as the variable delay device.

The variable delay device may be a DSP (digital signal process) system achieving a multi-function effect by performing a signal processing by the combination of an operation circuit and a RAM.

In the above described embodiments, the invention has been applied to the reverberation effect imparting device. The invention is applicable to various effect imparting devices using variable delay devices such as ones performing "delay" "phase shifting", "vibrato" and "tremolo" effects.

The effect imparting device according to the invention is not limited to a device incorporated in an electronic musical instrument but it may be designed as an independent device.

According to one aspect of the invention, when the delay length is to be changed, a delay output signal corresponding to delay length before the change is gradually attenuated and then, upon switching to a delay output signal corresponding to delay length after the change, the delay output signal is caused to rise gradually so that the signal level in the switching portion is restrained by the decay characteristic and the subsequent rise characteristic whereby a click noise produced in this portion can be eliminated.

As described in the foregoing, according to the other aspect of the invention, when the delay length is to be changed, a decay envelope is imparted to a delay output signal corresponding to the delay length before the change whereas a rise envelope is imparted to a delay output signal corresponding to the delay length after the change, and the two signals imparted with the envelopes of the opposite characteristics are combined to form a composite signal which constitutes the output signal of the variable delay device. Accordingly, if the delay output signal corresponding to the delay length before the change is not in phase with the delay output signal corresponding to the delay length after the change, the switching between the two signals is made smoothly owing to combination of the two signals imparted with the envelopes of the opposite characteristics whereby generation of a click noise in the switching portion can be prevented. Besides, since the two signals are combined in overlapping manner, the click noise can be prevented while the effect is being imparted without interruption during the change of the delay length.

As described in the foregoing, according to the other aspect of the invention, when the display length is to be changed, the delay length is gradually changed at a relatively small unit from the display length before the change to the delay length after the change so that if the output signal of the variable delay means corresponding to the delay length before the change is discontinuous in phase to the output signal of the variable delay means corresponding to the delay length after the change, the phase of the output signal of the variable delay means changes relatively smoothly and continuously whereby a click noise can be prevented.

What is claimed is:

1. An effect imparting device comprising:

variable delay means for delaying an input tone signal to impart an effect provided by this delay to the tone signal and being capable of changing length of this delay; and envelope imparting means for imparting, when the delay length of the variable delay means is to be changed, a decay envelope to an output signal of the variable delay means corresponding to a delay length before the change and thereafter imparting a rise envelope to an output of the variable delay means corresponding to a delay length after the change thereby to eliminate a click noise generated when the delay length is changed.

2. An effect imparting device as defined in claim 1 wherein the decay envelope is imparted to the output signal of the variable delay means corresponding to the delay length before the change for a predetermined period of time and thereafter delay length of the variable delay means is changed and the rise envelope is imparted to the output signal of the variable delay means corresponding to the delay length after the change.

3. An effect imparting device as defined in claim 1 wherein the decay envelope is imparted to the output signal of the variable delay means corresponding to the delay length before the change, the delay length of the variable delay means is changed when the level of this output signal has decreased below a predetermined level and the rise envelope is imparted to the output signal of the variable delay means corresponding to the delay length after the change.

4. An effect imparting device comprising:

variable delay means for delaying an input tone signal to impart an effect provided by this delay to the tone signal and being capable of changing length of this delay; and combining means for producing, when the delay length of the variable delay means is to be changed, at least a first delay output signal corresponding to a delay length before the change and a second delay output signal corresponding to a delay length after the change respectively from the variable delay means, imparting a decay envelope to the first delay output signal to gradually decrease the level of the first delay output signal, imparting, in parallel thereto, a rise envelope to the second delay output signal to gradually increase the level of the second delay output signal, and combining the two signals thus imparted with the envelopes together to provide the composite signal as a delayed output tone signal.

5. An effect imparting device as defined in claim 4 wherein the first and second delay output signals are produced by the variable delay means on a time shared basis.

6. An effect imparting device comprising:

variable delay means for delaying an input tone signal to impart an effect provided by this delay to the tone signal and being capable of changing length of this delay; and delay length changing means for changing, when the delay length of the variable delay means is to be changed, the delay length gradually at a relatively small unit from a delay length before the change to a delay length after the change thereby to prevent a click noise generated when the delay length is changed.

7. An effect imparting device comprising:

variable delay means for delaying an input tone signal to impart an effect provided by this delay to the tone signal and being capable of changing length of this delay;

delay length setting means for setting a delay length in the variable delay means;

change detection means for detecting that the delay length set by said delay length setting means has changed; and envelope imparting means for imparting, when the change has been detected by the change detection means, a decay envelope to an output signal of the variable delay means corresponding to a delay length before the change and thereafter imparting a rise envelope to an output signal of the variable delay means corresponding to a delay length after the change.

8. An effect imparting device as defined in claim 7 further comprising timer means for counting a predetermined length of time, starting the time counting when the change has been detected by said change detection means.

9. An effect imparting device as defined in claim 7 further comprising level detection means for detecting the level of the decay envelope imparted by the envelope imparting means and causing the envelope imparting means to start imparting of the rise envelope when the level has decreased below a predetermined level.

10. An effect imparting device comprising:

variable delay means for delaying an input tone signal to impart an effect provided by this delay to the tone signal and being capable of changing length of this delay;

delay length setting means for setting a delay length in the variable delay means;

change detection means for detecting that the delay length set by said delay length setting means has changed;

control signal generation means for generating, when the change has been detected by said change detection means, a decay envelope control signal in correspondence to the delay length before the change and a rise envelope control signal in correspondence to the delay length after the change;

combining means for causing the variable delay means to produce at least a first delay output signal corresponding to the delay length before the change and a second delay output signal corresponding to the delay length after the change, controlling the level of the first delay output signal with the decay envelope control signal and the level of the second delay output signal with the rise envelope control signal, combining the first and second delay output signals thus controlled in their level together and providing the composite signal as a delayed output tone signal.

11. An effect imparting device comprising:

variable delay means for delaying an input tone signal to impart an effect provided by this delay to the tone signal and being capable of changing length of this delay;

delay length setting means for setting a delay length in the variable delay means; and designation means for giving to the variable delay means, when the set delay length by the delay length setting means has been changed, designation to sequentially change the delay length in plural steps from the delay length before the change to the delay length after the change.

* * * * *